United States Patent [19]

Rassey

[11] 4,135,478

[45] Jan. 23, 1979

[54] MODULAR ENGINE CONSTRUCTION

[76] Inventor: Louis J. Rassey, 29048 Gloede, Warren, Mich. 48093

[21] Appl. No.: 733,996

[22] Filed: Oct. 20, 1976

[51] Int. Cl.[2] ..... F02B 75/16; F02F 7/00

[52] U.S. Cl. ..... 123/59 R; 123/195 C; 123/195 AC; 123/DIG. 1; 123/DIG. 6; 123/DIG. 7

[58] Field of Search ..... 123/DIG. 1, DIG. 6, 123/DIG. 7, DIG. 8, 55 R, 55 A, 56 R, 56 AA, 56 BA, 59 R, 195 R, 195 C, 195 S, 195 AC

[56] References Cited

U.S. PATENT DOCUMENTS

| | | | |
|---|---|---|---|
| 690,443 | 1/1902 | Kull | 123/59 A |
| 719,072 | 1/1903 | Annesley | 123/59 A |
| 904,562 | 11/1908 | Rathbun | 123/59 A |
| 1,019,513 | 3/1912 | Moore | 123/55 R |
| 1,299,709 | 4/1919 | Hall | 123/195 H |
| 1,764,147 | 6/1930 | Burtnett | 123/56 BA |
| 2,019,558 | 11/1935 | Brush | 123/195 R |
| 2,048,018 | 7/1936 | Meyer | 123/55 R |
| 2,311,146 | 2/1943 | Wiegman | 123/56 AA |
| 2,671,436 | 3/1954 | Pitt | 123/DIG. 7 |
| 3,561,416 | 2/1971 | Kiekhaefer | 123/DIG. 8 |
| 3,568,649 | 3/1971 | Syson | 123/195 R |
| 3,738,338 | 6/1973 | Wickman | 123/55 R |

FOREIGN PATENT DOCUMENTS

| | | | |
|---|---|---|---|
| 515493 | 12/1930 | Fed. Rep. of Germany | 123/DIG. 7 |

*Primary Examiner*—Charles J. Myhre
*Assistant Examiner*—Craig R. Feinberg
*Attorney, Agent, or Firm*—Gifford, Chandler, VanOphem, Sheridan & Sprinkle

[57] ABSTRACT

A modular internal combustion engine is provided in which a single crankcase can be adapted to a plurality of different types of engine configurations. The crankcase is open at its top so that each upper side edge of the crankcase forms a mounting flange while a crankshaft is rotatably carried by the crankcase. Block members and adapter members are provided and each includes a mounting flange formed along each longitudinal side. All of the mounting flanges are substantially identical to each other so that any one mounting flange can be detachably secured to another mounting flange. Thus to construct the engine, one mounting flange of either the block or adapter member is attached to one crankcase mounting flange while one mounting flange on the other member is attached to the other crankcase mounting flange. In addition, the remaining mounting flanges on the block and adapter members register with each other and are secured together. At least one block member is utilized in each configuration and the block member is adapted to reciprocally carry at least one piston therein. The piston in turn is operatively coupled to the crankshaft to rotatably drive the crankshaft upon reciprocation of the piston in the conventional manner.

5 Claims, 9 Drawing Figures

MODULAR ENGINE CONSTRUCTION

BACKGROUND OF THE INVENTION

I. Field of the Invention

The present invention relates generally to internal combustion engines and, more particularly, to a modular internal combustion engine.

II. Description of the Prior Art

There are a number of previously known internal combustion engines many of which are particularly adapted for driving motor vehicles, such as automobiles. These previously known engines typically comprise an engine block and a crankcase. A plurality of pistons are reciprocally carried in a like number of cylinders formed through the engine block. Each piston is operatively coupled to and rotatably drives a crankshaft carried in the crankcase upon reciprocation of the pistons.

Of these latter types of internal combustion engines, several well-known and commonly utilized engine configurations have evolved. These engine configurations, which are named after the visual appearance of the engine block on the crankcase, are commonly known in the trade as a V-type engine, a slant-type engine, and a straight-in-line type engine.

In a V-type engine, the engine block includes two cylinder banks in a spaced relation so the axis of one cylinder bank forms one side of a V while the axis of the other cylinder bank forms the other side of the V. The crankshaft, of course, is disposed at the bottom of the V.

A slant-type engine is another type of engine configuration in which the engine block includes a single bank of cylinders in line with each other. However, when the engine is viewed axially along the crankshaft, the axis of the cylinders are skewed with respect to the vertical. A slant type engine, of course, can be either a slant-left or a slant-right engine.

A still further type of engine configuration is a straight-in-line engine in which the engine block includes a single bank of cylinders axially aligned with each other. However, unlike the slant-type engine, the axes of the cylinders within the engine block are substantially vertical.

With these previously known internal combustion engines, both the crankcase and the engine block are different for each different engine configuration. Thus, in order to construct all four engine configurations, i.e., the V-type, slantright, slant-left, and straight-in-line engine configurations, it is necessary to construct not only four different crankcases but also four different engine blocks. This multiplicity of different components for the different engine configurations, of course, increases the overall cost of a production line of engines including more than one of the different engine configurations.

SUMMARY OF THE PRESENT INVENTION

The present invention overcomes the above-mentioned disadvantages of the different engine configurations by providing a modular engine construction whereby any of the four aforementioned engine configurations can be constructed by utilizing common engine components.

In brief, the modular internal combustion engine of the present invention comprises a crankcase having a mounting flange formed on each of its two longitudinal upper sides. Block members and adapter members are also provided and each includes a mounting flange formed along each of its longitudinal sides. Each mounting flange is substantially identical to the other mounting flanges so that any two mounting flanges can register with and be secured to each other. Thus, to construct the modular engine one block member mounting flange is secured to one crankcase mounting flange while one adapter member mounting flange is secured to the other crankcase mounting flange. The other two mounting flanges on the block and adapter members also register with each other and are secured together. Since each mounting flange is substantially identical, the block and adapter members are not only reversibly mountable on the crankcase, but are also interchangeable with each other.

Each block member reciprocally carries at least one piston member therein. Each piston member is operatively coupled to a crankshaft rotatably carried within the crankcase so that upon reciprocation, the piston or pistons rotatably drive the crankshaft.

Since the block member and adapter member are both reversibly and interchangeably mounted onto the crankcase, if one block member and one adapter member is used, a slantright or a slant-left engine will be obtained depending upon which side the adapter member is mounted.

In order to construct a V-type engine, a second block member replaces the adapter member so that two block members are used.

In order to construct a straight-in-line engine, a block member is disposed vertically on the crankcase between two half-size adapter members. Each half-size adapter member, of course, includes a mounting flange along each longitudinal side for attachment to both the block member along one side and the crankcase along the other side.

As a still further feature of the present invention, the crankshaft includes a plurality of crank pins, each of which is adapted for connection to one or two pistons. By reversing the position of the block member on the crankcase, the connection between the piston and the crankshaft is axially offset on each crank pin. As will become hereinafter more clearly apparent, this construction permits the same crankshaft to be utilized regardless of the type of engine configuration.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
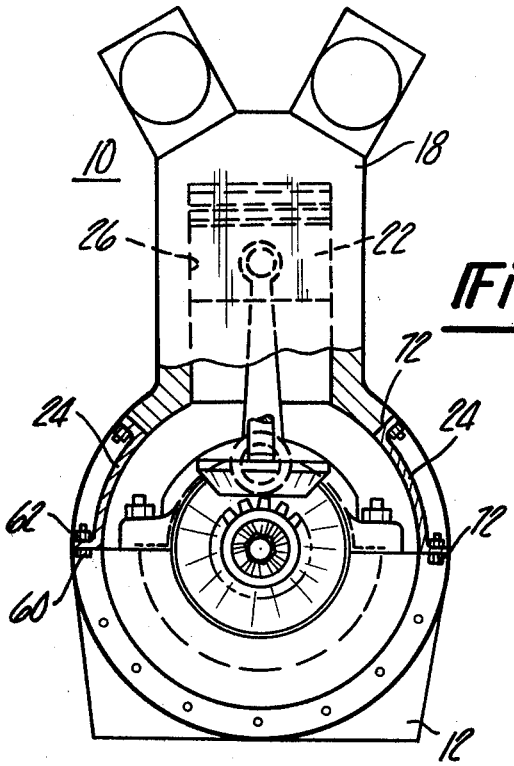
FIG. 1 is a front plan view in partial cross-section showing the modular engine of the present invention assembled to provide a straight-in-line engine.
Figure 3:
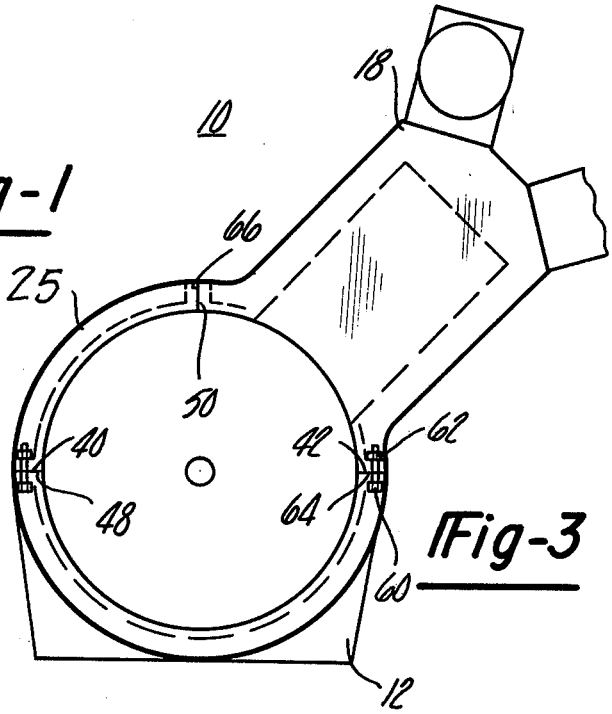
FIG. 3 is a front plan view similar to both FIGS. 1 and 2 but showing the modular engine of the present invention assembled to provide a slant-type engine.
Figure 2:
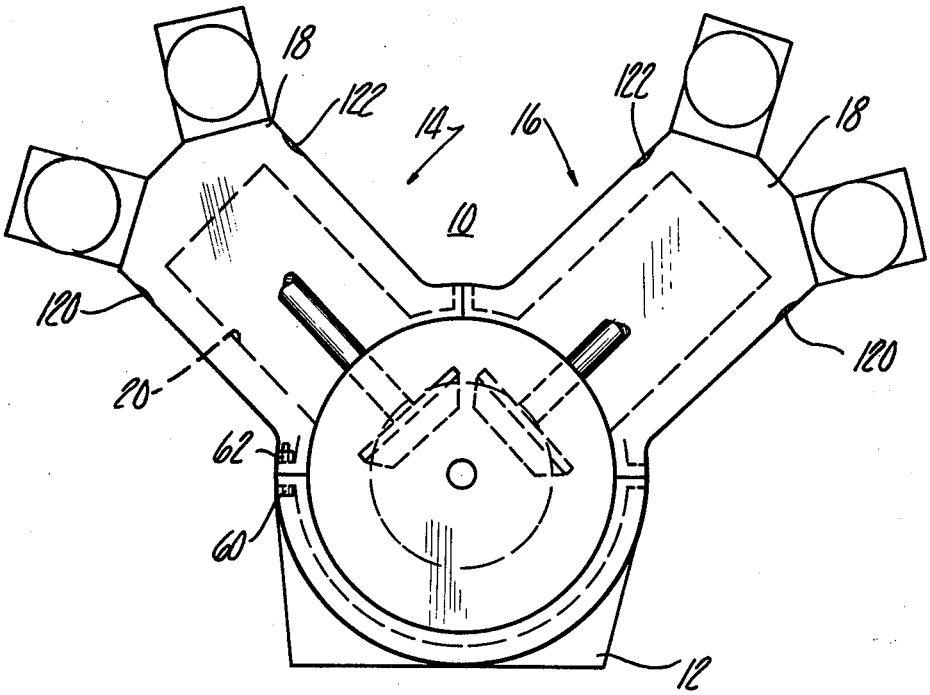
FIG. 2 is a front plan view similar to FIG. 1 but showing the modular engine of the present invention assembled to provide a V-type engine.

With reference first to FIGS. 1-3 the modular engine 10 of the present invention is thereshown in a number of different engine configurations. In particular, FIG. 1 illustrates the modular engine 10 in a straight-in-line engine configuration while FIG. 2 illustrates the modular engine 10 in a V-type engine configuration. FIG. 3 illustrates the modular engine 10 in a slant-right configuration.

The engine 10 in each configuration comprises a crankcase 12 and at least one block member 18 secured on to the crankcase 12 in a manner to be hereinafter described in detail.

Each block member 18 includes at least one piston 22 reciprocally carried in a cylinder 20 formed in the engine block 18. Each block member 18 illustrated in the drawings is substantially identical and for ease of description it will be assumed that four preferably equidistantly spaced cylinders 20 are formed in each block member 18. It should be understood, however, that a different number of cylinders can be formed within the block member 18 while remaining within the scope of the invention.

Referring again to FIG. 1 in the in line construction shown, only one block member 18 is used and it is mounted to the crankcase 12 by adapter plates 24 as will be later described in detail.

In the V-type engine illustrated in FIG. 2, two block members 18 are mounted directly to the crankcase 12.

In the slant-type engine illustrated in FIG. 3 a block member 18 is mounted along one side directly to the crankcase 12 while on the other side an adapter member 25 is mounted between the crankcase 12 and the block member 18.

Figure 4:
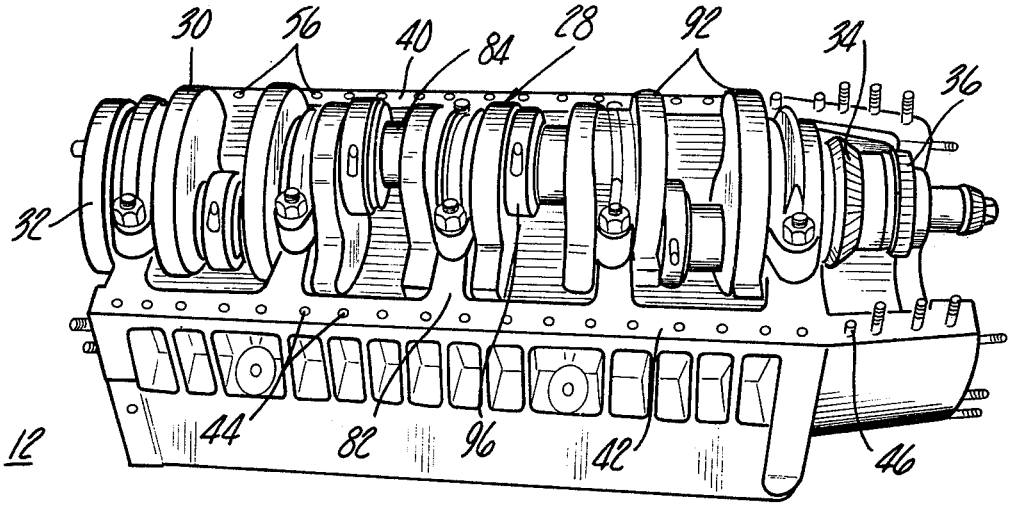
FIG. 4 is a side plan elevational view showing the crankcase for the modular engine of the present invention and with parts removed for clarity.

The crankcase 12 is illustrated with more clarity in FIG. 4 and includes a plurality of vertical webs 28 which increase the strength of the crankcase 12 while maintaining the crankcase weight at a minimum. A crankshaft 26 is rotatably carried in the crankcase 12 by bearing members 30. A flywheel 32 is provided at the rear end of the crankshaft 26 for attachment to the transmission of a vehicle (not shown) while pinions 34 and 36 are coupled to the front end of the crankshaft 26 for rotatably driving the engine distributor, overhead cams, and the like as will be later described.

Each upper longitudinal side of the crankcase 12 forms a horizontal mounting flange 40 and 42 adapted for attachment to either a block member 18, an adapter plate 24, or an adapter member 25 depending upon the type of engine being assembled. The mounting flanges 40 and 42 are substantially identical with each other and each includes a plurality of apertures 44 formed therethrough and preferably at least one positioning pin 46 at its forward end. The axis of each aperture 44 and of the positioning pin 46 is preferably vertically disposed and thus substantially perpendicular to the plane of the flanges 40 and 42.

Figure 5:
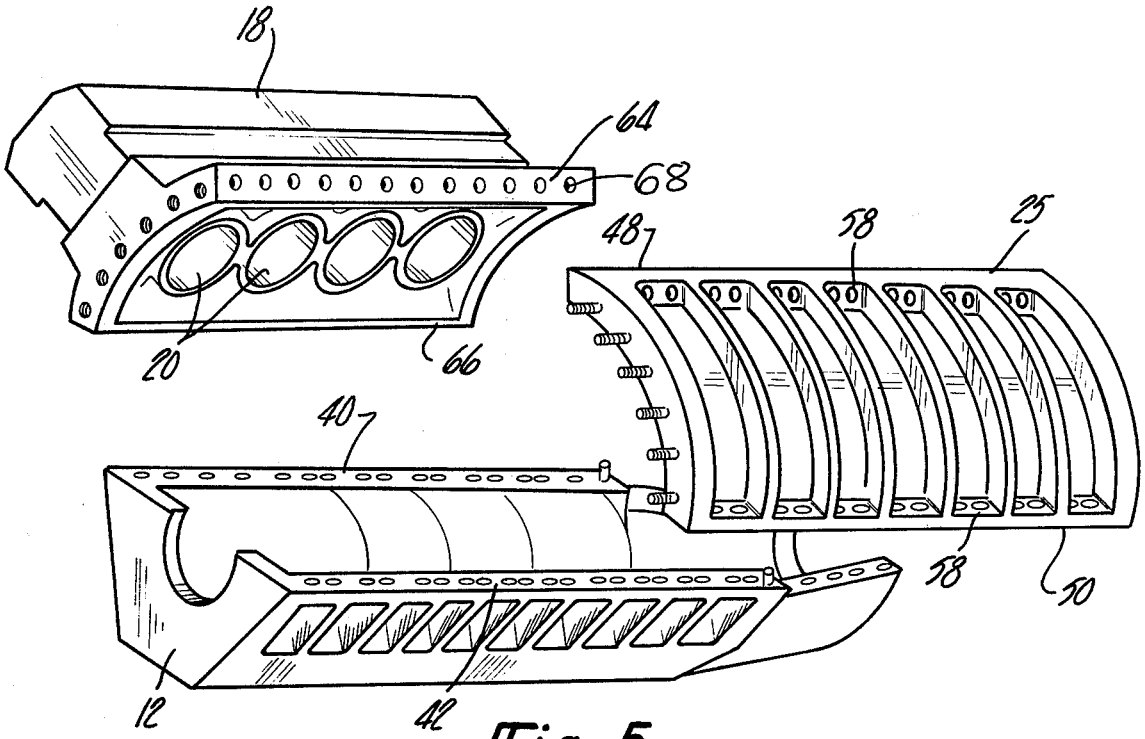
FIG. 5 is an exploded perspective view illustrating the modular engine of the present invention assembled to provide a slant-right type engine and with parts removed for clarity.

With reference now to FIGS. 3 and 5, the adapter member 25 includes a first and second mounting flanges 48 and 50, respectively, each of which includes appropriate apertures 58 formed therethrough. The longitudinal axes of the mounting flanges 48 and 50 are preferably parallel but the plane of the flanges 48 and 50 are perpendicular. The mounting flanges 48 and 50 on the adapter member 25 are substantially identical to either of the mounting flanges 40 and 42 on the crankcase 12 so that with the adapter member 25 mounted onto the crankcase 12 as shown in FIG. 3, the flanges 40 and 48 register and flatly abut against each other. Preferably the positioning pin 46 on the crankcase 12 is received within an appropriate recess in the adapter member 25 so that the apertures 58 register with the apertures 44. Appropriate bolts 60 extend through the registering apertures 58 and 44 and threadably engage nuts 62 to thereby secure the adapter member 25 and the crankcase 12 together along the mounting flanges 40 and 48.

Still referring to FIGS. 3 and 5, the block member 18 also includes a first and second mounting flange 64 and 66, respectively, the axes of which are preferably parallel while the planes are perpendicular with each other and each flange 64 and 66 includes a plurality of apertures 68 formed therethrough. In the engine configuration shown in FIG. 3 the block member 16 is positioned on the crankcase 12 so that the mounting flanges 42 and 64 flatly abut and the apertures 68 in the mounting flange 64 register with the apertures 44 in the mounting flange 42. As before, appropriate nut and bolt members 62 and 60, respectively, extend through the registering apertures 68 and 44 in order to secure the block member 16 to the crankcase 12.

As is best seen in FIG. 3, with the mounting flanges 48 and 64 on the adapter and block members 25 and 18, respectively, secured to their respective mounting flanges on the crankcase 12, the other mounting flanges 50 and 66 on the adapter and block members 25 and 18, respectively, register with and flatly abut against each other so that the apertures 68 and 58 are in registration. As before, appropriate nut and bolt members 62 and 60 secure the adapter and block members 25 and 18 together along the mounting flanges 66 and 50.

All of the flanges 40, 48, 50, 66, 42, and 64 are substantially identical to each other so that either mounting flange on either the adapter member 25 or block member 18 can be secured to either mounting flange 40 or 42 on the crankcase. Since the mounting flanges are all substantially identical, the adapter member 25 and block member 18 can, not only be interchanged on the crankcase 12, but can also be reversed, i.e., turned end to end, on the crankcase 12. Reversal of the engine block 18, of course, also reverses the lateral position of the block member exhaust port 120 and intake port 122 relative to the crankcase 12.

The interchangeability and reversibility of the adapter and block members 25 and 18 upon the crankcase 12 permits the construction of the various engine configurations in a modular fashion. For example the slant-right engine of FIG. 3 has been previously described. By interchanging the adapter member 25 with the block member 18, the slant-left engine illustrated in FIG. 4 is obtained. Moreover, by replacing the adapter member 25 in either FIGS. 3 or 4 with a second block member 18, the V-type engine illustrated in FIG. 2 is obtained.

In the straight-in-line engine illustrated in FIG. 1 block member 18 is positioned vertically above the crankcase 12. The adapter member 25, however, is divided into two half segments or adapter plates 24, each of which is identical to the other and includes a longitudinal mounting flange 72 along each side. Each mounting flange 72 is substantially identical to the other flanges 40, 48, 50, 66, 42, and 64. Each segment 24 is disposed between one mounting flange 40 or 42 on the crankcase 12 and one mounting flange 64 or 66 on the block member 18 and, as before, the abutting flanges are secured together by appropriate fasteners 60 and 62.

With reference now to FIG. 5–8, the same crankshaft 28 can be used for any of the engine configurations illustrated in FIGS. 1–4. It will be remembered that for the purpose of description only, the block member 18 includes four cylinders 20, each of which reciprocally carries one piston 22.

Four crank pins 84 are axially spaced along the crankshaft 26 so that the central two crank pins 84 are coaxial with each other while the outer two crank pins 84 are also coaxial with each other but offset from the central two crank pins 84 by 180°.

A connecting rod 86 is pivotally coupled on one end by a wrist pin 88 to each piston 22 and at its lower end to the crank pin 84 by a connector 90. Each crank pin 84 is of an axial length sufficient to accommodate the attachment of two connecting rods 86 thereon so that two connecting rods 86 can be connected to a single crank pin 84. Conventional crank throw webs 92 are also included between each crank pin 84 as counterweights.

Figure 7:
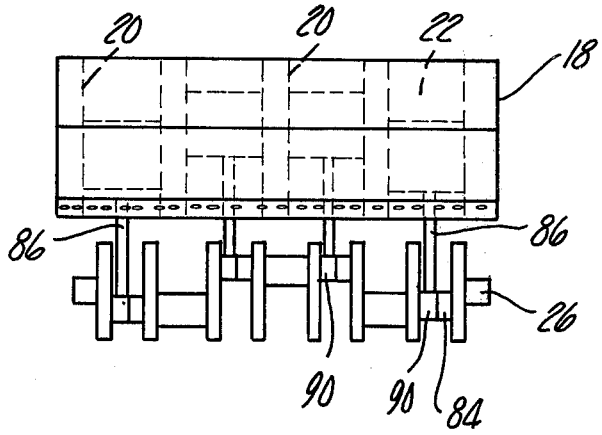
FIG. 7 is a side diagrammatic view similar to FIG. 6 but showing the engine block in its reversed position.

With reference now to FIG. 7, the cylinders 20 in the block member 18 are axially positioned such that the connecting rod 86 of each piston 22 registers with the front axial half of each crank pin 84. Preferably annular spacers 96 (FIG. 4) are positioned on the rear half of each crank pin 84 in order to prevent axial vibration of the connecting rod 86 along the crank pin 84.

Figure 6:
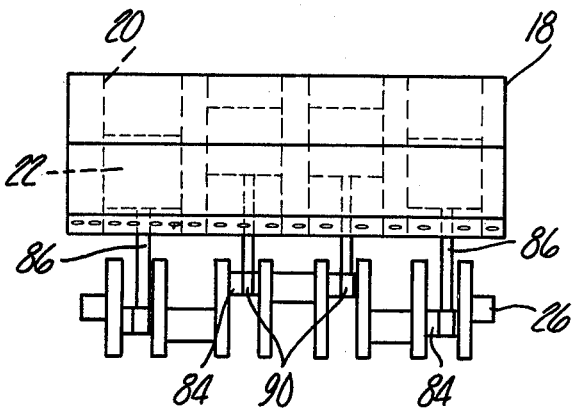
FIG. 6 is a side diagrammatic view illustrating the attachment between the piston members and the crankshaft with the engine block in one position.

The axis of each cylinder 20 within the cylinder block 18 is offset with relation to the crankshaft 28 so that upon reversal of the block member 18 upon the crankcase 12, the connecting rods 86 of each piston 22 register with the rear half of the crank pins 84, as shown in FIG. 6. In this event, of course, the spacers 96 would be moved from the rear to the front axial half of the crank pins 84. This axial offset of the cylinder axes upon reversal of the block member 18 is substantially one-half of the axial length of the crank pin 84.

Figure 8:
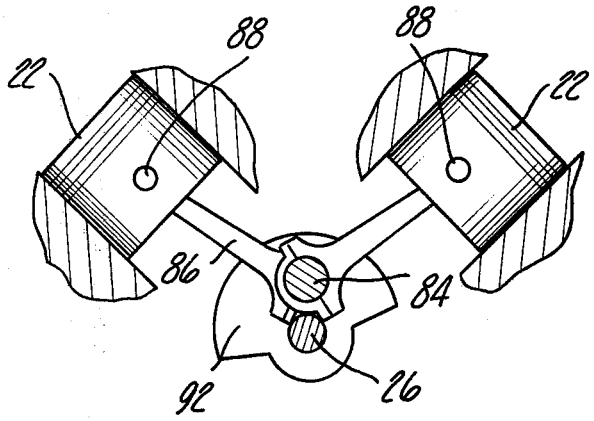
FIG. 8 is a fragmentary front cross-sectional view illustrating the attachment between the pistons and the crankshaft for the modular engine of the present invention assembled to provide a V-type engine.

The offset of the cylindrical axes in the block member 18 obtained upon a reversal of the block member 18 upon the crankcase 12 also permits the same crankshaft 28 to be used in the V-type engine illustrated in FIG. 3. As shown in FIG. 8, in a V-type engine the spacers 96 are entirely removed from the crank pins 84 so that the piston connecting rods 86 from one block member 18 are attached by the connectors 90 to the front axial half of each crank pin 84. The position of the other block member 18 is reversed on the crankcase 12 from the first block member 18 so that the piston connecting rods 86 from the second block member 18 register with and are attached by the pins 90 to the rear axial half of each crank pin 84. As shown in FIG. 2, the reversed position of the block members 18 on the crankcase 12 in a V-type engine also automatically positions the engine exhaust 120 and intake ports 122 on opposite sides of the block members 18. Typically the exhaust ports 120 are on the outside and the intake ports 122 on the inside of the engine 10.

Figure 9:
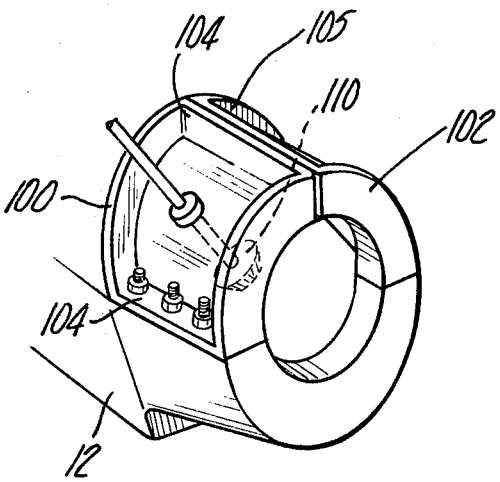
FIG. 9 is a fragmentary exploded perspective view showing a still further feature of the present invention.

With reference now to FIG. 9, a further feature of the present invention is thereshown in which a cam drive member 100 and a cam adapter member 102 are secured to one axial end of the crankcase 12 so that the members 100 and 102 enclose the pinions 34 and 36. Both the cam drive member 100 and the cam adapter member 102 include a mounting flange 104 and 105, respectively, along each side which are substantially identical. The mounting flange 104 on the cam drive member 100 is attached to one side of the crankcase 12 by appropriate fasteners while one mounting flange 105 of the cam adapter member 102 is attached to the other side of the crankcase 12. With the cam drive member 100 secured to one side of the crankcase 12 and the cam adapter member 102 secured to the other side of the crankcase 12, the remaining mounting flanges 104 and 105 on the members 100 and 102, respectively, flatly abut and are secured together. The cam dirve member 100 and the cam adapter member 102 are interchangeable.

The cam drive member 100 includes a pinion 110 which meshes with the pinion 34 and rotatably drives an overhead cam arrangement (not shown). In a V-type engine configuration a second cam drive member 100 replaces the cam adapter member 102.

The other camshaft pinion 36 can be used, for example, to rotatably drive an engine distributor in any conventional fashion.

From the foregoing, it can be seen that the present invention provides a novel modular engine construction in which a plurality of engine configurations can be obtained while utilizing a common crankcase and a common crankshaft. In addition, the block members 18 are substantially identical to each other and can be used in any of the multiple types of engine configurations.

No internal combustion engine heretofore known enjoys the modular construction of the present invention in which a plurality of different engine configurations can be constructed while utilizing common engine components.

It should be apparent that although the present invention has been described with particular reference to an internal combustion engine, the concept disclosed herein can with little modification be used to provide modularly constructed compressors as well. Therefore, when the word "engine" is used herein in the specification and claims, it is intended to encompass both internal combustion engines and compressors.

Having thus described my invention, many modifications thereto will become apparent to those skilled in the art to which it pertains without deviating from the spirit of the invention as defined by the scope of the appended claims.

I claim:

1. A modular engine comprising:

a crankcase open at its top and forming a mounting flange along each upper side of the crankcase;

a crankshaft rotatably carried by the crankcase;

an engine block having a mounting flange formed along each side and positioned substantially vertically on said crankcase;

a pair of adapter plates, each having a mounting flange formed on each side, said adapter plates being positioned on the crankcase so that the mounting flanges of one adapter plate respectively register with one crankcase flange and one engine block flange whereby the flanges of the other adapter plate respectively register with the other crankcase and engine block flanges;

means for securing said registering flanges together;

wherein said engine block is adapted to reciprocally carry at least one piston member therein said piston member being operatively coupled to said crankshaft to effect the rotation of the crankshaft upon reciprocation of the piston member within the engine block, and wherein each of said flanges are formed in substantially an axially extending radial plane with respect to the axis of the crankshaft, each of said flanges being substantially 2. A modular engine comprising:

a crankcase open at its top and forming a mounting flange along each upper side of the crankcase;

a crankshaft rotatably carried by the crankcase;

a first member having a mounting flange formed along each side, said first member being positioned on said crankcase so that one first member flange registers with one of the crankcase flanges;

a second member having a mounting flange formed on each side, said second member being positioned on the crankcase so that one second member flange registers with the other crankcase flange whereby the other second member flange registers with the other first member flange;

means for securing said registering flanges together;

wherein one of said members is an engine block adapted to reciprocally carry at least one piston member therein, said piston member being operatively coupled to said crankshaft to effect the rotation of the crankshaft upon reciprocation of the piston member within the engine block, and wherein the other member is an adapter plate.

3. The invention as defined in claim 2 wherein the first and second members are reversibly mountable on said crankcase.

4. The invention as defined in claim 2 wherein each mounting flange is substantially identical to the other mounting flanges whereby either mounting flange on either member can be attached to either crankcase mounting flange.

5. The invention as defined in claim 4 wherein said first and second members are reversibly mountable on said crankcase.

* * * * *

UNITED STATES PATENT AND TRADEMARK OFFICE

CERTIFICATE OF CORRECTION

PATENT NO. : 4,135,478

DATED : January 23, 1979

INVENTOR(S) : Louis J. Rassey

It is certified that error appears in the above-identified patent and that said Letters Patent are hereby corrected as shown below:

Column 7, line 11 after substantially insert --equidistantly radially spaced from the axis of said crankshaft whereby said securing means are accessible exteriorly of said engine.--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*